US011329431B2

(12) United States Patent
Pao et al.

(10) Patent No.: US 11,329,431 B2
(45) Date of Patent: May 10, 2022

(54) CONNECTION DEVICE AND FLOATING CONNECTION ASSEMBLY

(71) Applicant: STARCONN ELECTRONIC (Su Zhou) Co., LTD, Kunshan (CN)

(72) Inventors: Chung-Nan Pao, New Taipei (TW); Heng-Shan Cheng, Kunshan (CN); Xuan-Hao Chen, New Taipei (TW); Yan Xu, Kunshan (CN)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 0 days.

(21) Appl. No.: 17/030,383

(22) Filed: Sep. 24, 2020

(65) Prior Publication Data

US 2021/0376528 A1 Dec. 2, 2021

(30) Foreign Application Priority Data

May 29, 2020 (CN) ..... 202010474108.X

(51) Int. Cl.
*H01R 13/631* (2006.01)
*H01R 13/74* (2006.01)

(52) U.S. Cl.
CPC ..... *H01R 13/6315* (2013.01); *H01R 13/748* (2013.01)

(58) Field of Classification Search
CPC ..... H01R 12/91; H01R 13/74; H01R 13/746; H01R 13/748; H01R 13/6315
USPC ..... 439/246–248, 544, 550, 551, 562, 564, 439/565, 573, 361, 362, 378
See application file for complete search history.

(56) References Cited

U.S. PATENT DOCUMENTS 3,951,500 A * 4/1976 Anderson ..... H01R 13/631 439/248
4,812,133 A * 3/1989 Fleak ..... H01R 13/631 439/248
5,205,755 A * 4/1993 Douty ..... H01R 13/6315 248/27.1
5,383,790 A * 1/1995 Kerek ..... H01R 13/6315 439/152
5,516,303 A * 5/1996 Yohn ..... H01R 13/6315 439/248
5,752,845 A * 5/1998 Fu ..... B60R 22/26 439/247
5,857,863 A * 1/1999 Onizuka ..... B60R 16/0207 439/248
6,017,233 A * 1/2000 Fry ..... H01R 13/6315 439/248

(Continued)

*Primary Examiner* — Marcus E Harcum
(74) *Attorney, Agent, or Firm* — Li & Cai Intellectual Property Office

(57) ABSTRACT

A connection device and a floating connection assembly are provided. The floating connection assembly includes a floating connector and an assembling module. The floating connector includes a floating module and a main body. The floating module defines an assembling region and a plurality of holding regions that are distributed around the assembling region. The main body is inserted into the assembling region of the floating module. The assembling module is retained by the floating module through the holding regions. The floating module and the assembling module are jointly configured to movably clamp a panel, and are jointly movable relative to the panel.

15 Claims, 10 Drawing Sheets

(56) References Cited

U.S. PATENT DOCUMENTS 6,234,817 B1 * 5/2001 Hwang ..... H01R 13/6315 439/247
6,290,523 B1 * 9/2001 Barnhart ..... H01R 13/6315 439/248
6,406,192 B1 * 6/2002 Chen ..... H01R 13/6315 385/56
6,527,572 B2 * 3/2003 Jou ..... H01R 13/6315 439/247
6,648,676 B1 * 11/2003 Lee ..... H01R 43/24 439/499
6,736,659 B1 * 5/2004 Wu ..... H01R 13/6315 439/247
6,739,891 B2 * 5/2004 Itoh ..... H01R 13/6315 439/174
6,890,200 B1 * 5/2005 Wu ..... H01R 13/6315 439/247
6,923,679 B1 * 8/2005 Wu ..... H01R 13/6315 439/573
7,090,521 B2 * 8/2006 Nishio ..... H01R 13/6315 439/248
7,393,228 B2 * 7/2008 Kabasawa ..... H01R 13/631 439/247
7,549,885 B1 * 6/2009 Oh ..... H01R 13/6215 439/247
7,559,796 B1 * 7/2009 Wu ..... H01R 13/748 439/564
7,607,930 B1 * 10/2009 Wu ..... H01R 13/745 439/247
8,357,000 B1 * 1/2013 Albrecht ..... F41A 25/00 439/248
8,366,469 B2 * 2/2013 Carnevali ..... G06F 1/1632 439/248
8,632,359 B2 * 1/2014 Grimm ..... H01R 9/2425 439/545
9,337,577 B1 * 5/2016 Hitchcock ..... H01R 13/6315
9,698,528 B2 * 7/2017 Nishida ..... H01R 13/6315
10,411,419 B2 * 9/2019 You ..... H01R 13/2421
10,931,045 B2 * 2/2021 Aoki ..... H01R 24/60
10,958,014 B1 * 3/2021 Martin ..... H01R 13/6315
10,971,850 B2 * 4/2021 Shioda ..... H01R 12/707
11,031,730 B2 * 6/2021 Mitter ..... H01R 13/502
2002/0048982 A1 * 4/2002 Gu ..... H01R 13/6315 439/247
2006/0141836 A1 * 6/2006 Van Der Mee .... H01R 13/6315 439/247
2008/0293277 A1 * 11/2008 Kumar ..... H01R 13/53 439/247
2009/0068870 A1 * 3/2009 Mezhinsky ..... H01R 13/6315 439/247
2015/0044901 A1 * 2/2015 Doi ..... H01R 13/41 439/374
2015/0071675 A1 * 3/2015 Suzaki ..... G03G 15/80 399/90
2016/0111804 A1 * 4/2016 Saito ..... H01R 13/18 439/733.1
2016/0308311 A1 * 10/2016 Hori ..... H01R 13/7032

* cited by examiner

CONNECTION DEVICE AND FLOATING CONNECTION ASSEMBLY

CROSS-REFERENCE TO RELATED PATENT APPLICATION

This application claims the benefit of priority to China Patent Application No. 202010474108.X, filed on May 29, 2020 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to a connection device and a floating connection assembly.

BACKGROUND OF THE DISCLOSURE

A conventional floating connector assembled onto a panel can be used to absorb or decrease a deviation by making some components thereof to be slightly floatable. However, the structure of the conventional floating connector has been limited by an existing technical prejudice (e.g., the floating mechanism cannot be related to the panel), so that the conventional floating connector is difficult to be significantly changed and improved.

SUMMARY OF THE DISCLOSURE

In response to the above-referenced technical inadequacies, the present disclosure provides a connection device and a floating connection assembly to effectively improve on the issues associated with conventional floating connectors.

In one aspect, the present disclosure provides a connection device, which includes a panel and a floating connection assembly. The panel has a first thru-hole and a plurality of second thru-holes that are arranged around the first thru-hole. The floating connection assembly includes a floating connector and an assembling module. The floating connector includes a floating module and a main body. The floating module defines an assembling region and a plurality of holding regions that are distributed around the assembling region and that respectively correspond in position to the second thru-holes. The main body is inserted into the assembling region of the floating module and passes through the first thru-hole. The assembling module passes through the second thru-holes and is retained by the floating module through the holding regions. The floating module and the assembling module are jointly configured to movably clamp the panel. The main body is spaced apart from an inner wall of the first thru-hole by a distance, and a portion of the assembling module arranged in any one of the second thru-holes is spaced apart from an inner wall of the corresponding second thru-hole by a distance, so that the floating connector and the assembling module are jointly movable relative to the panel.

In another aspect, the present disclosure provides a floating connection assembly, which includes a floating connector and an assembling module. The floating connector includes a floating module and a main body. The floating module defines an assembling region and a plurality of holding regions that are distributed around the assembling region. The main body is inserted into the assembling region of the floating module. The assembling module is retained by the floating module through the holding regions, and the floating module and the assembling module are jointly configured to movably clamp a panel, and are jointly movable relative to the panel.

Therefore, the floating connector and the assembling module of the floating connection assembly in the present disclosure are jointly used in cooperation with the panel so as to provide the floating connection assembly with a floating function for overcoming the existing technical prejudice. Specifically, the main body of the floating connector can be floated (or moved) along different directions to effectively improve (or absorb) a deviation generated from the floating connector, so that the floating connector can be precisely inserted into the mating connector.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
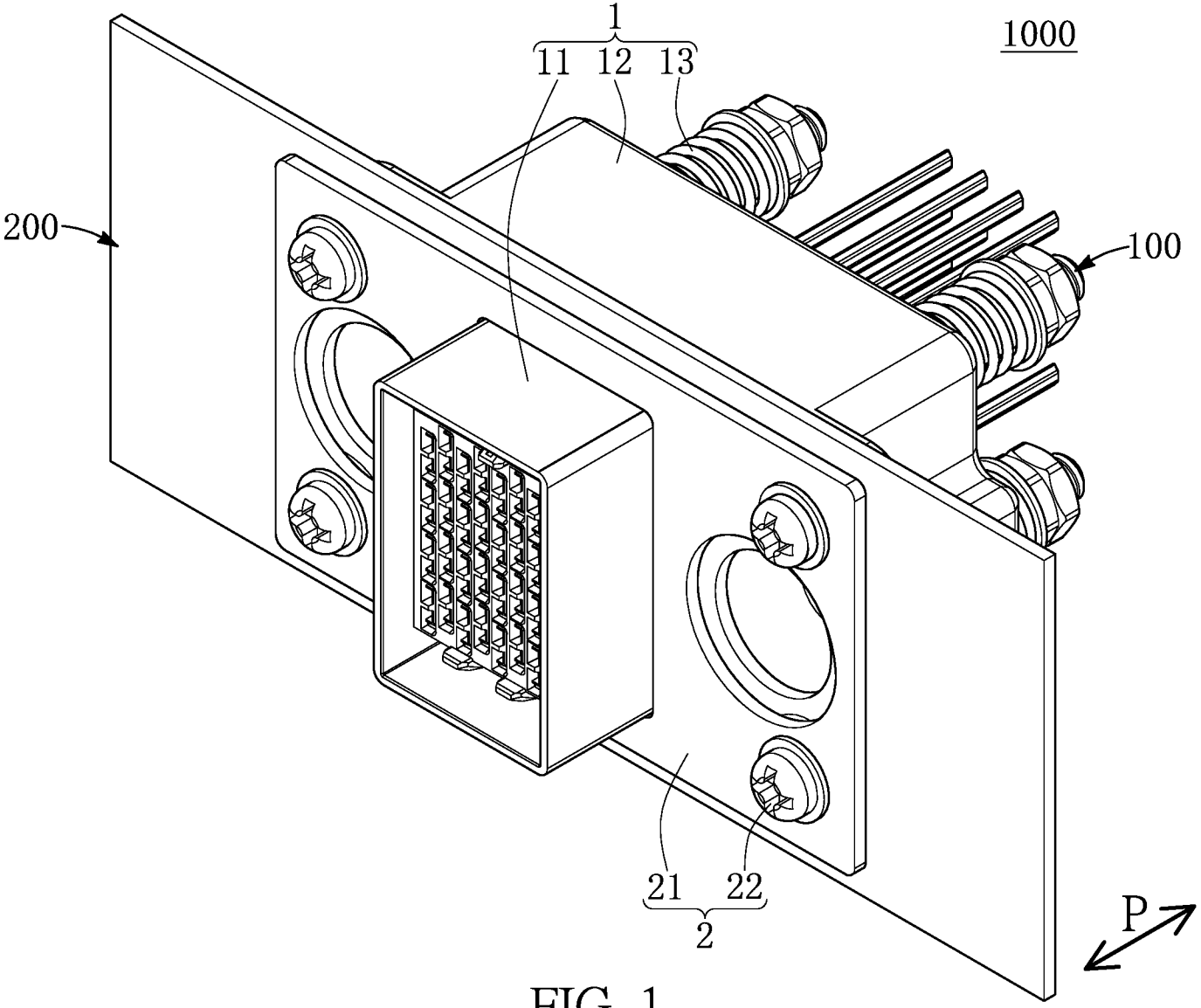
FIG. 1 is a perspective view of a connection device according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
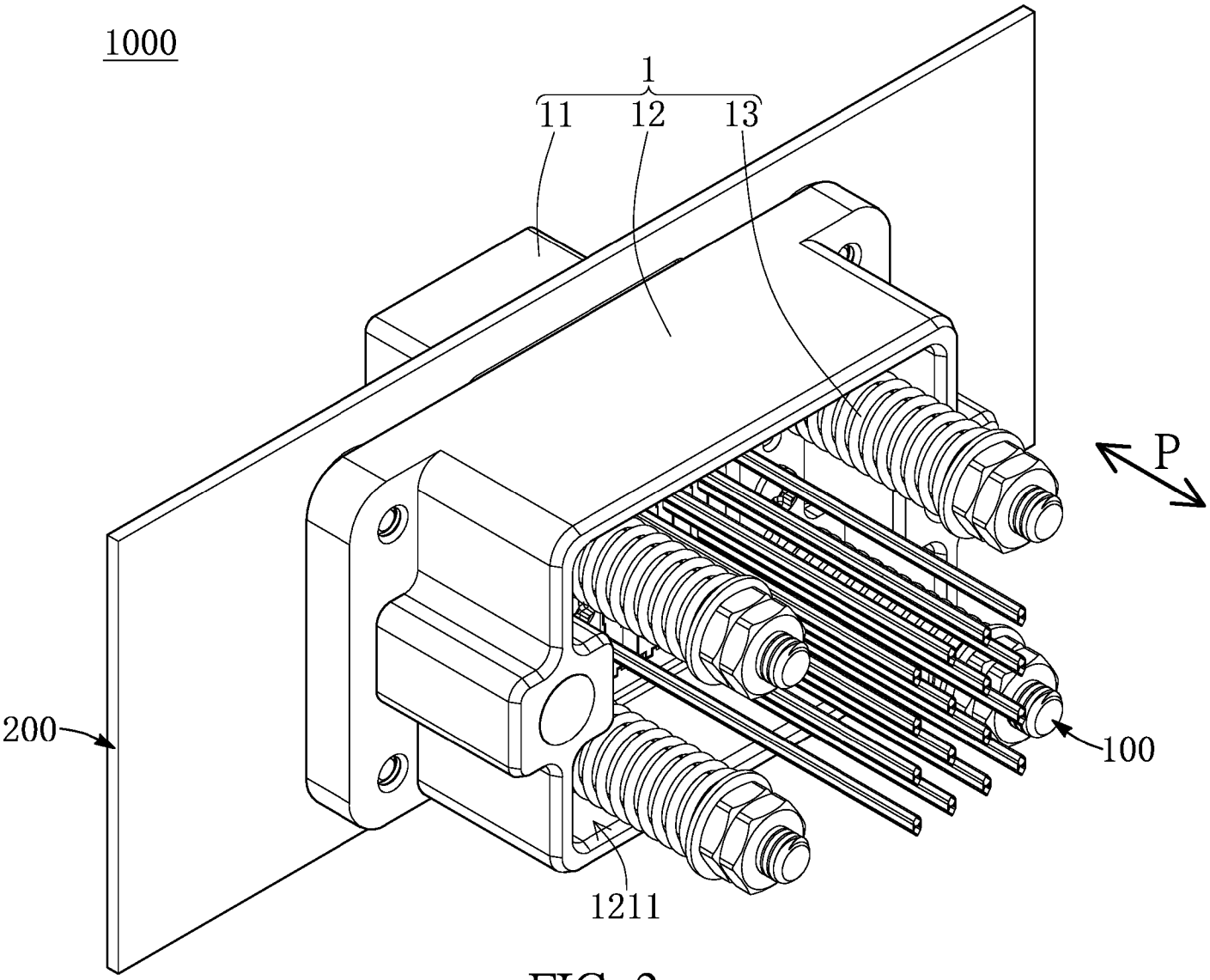
FIG. 2 is a perspective view of the connection device from another angle of view according to the embodiment of the present disclosure.
Figure 3:
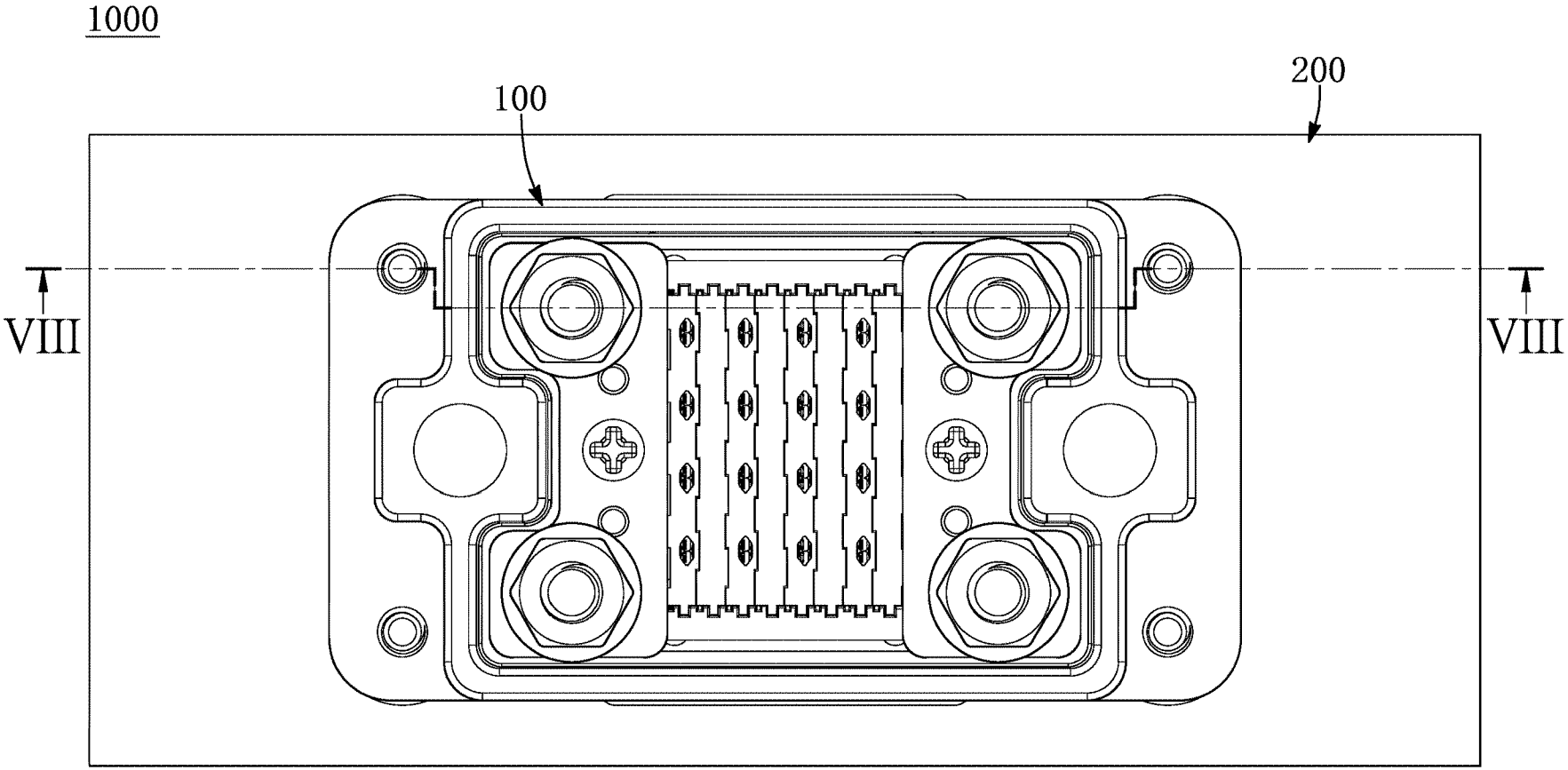
FIG. 3 is a rear view of FIG. 1.
Figure 4:
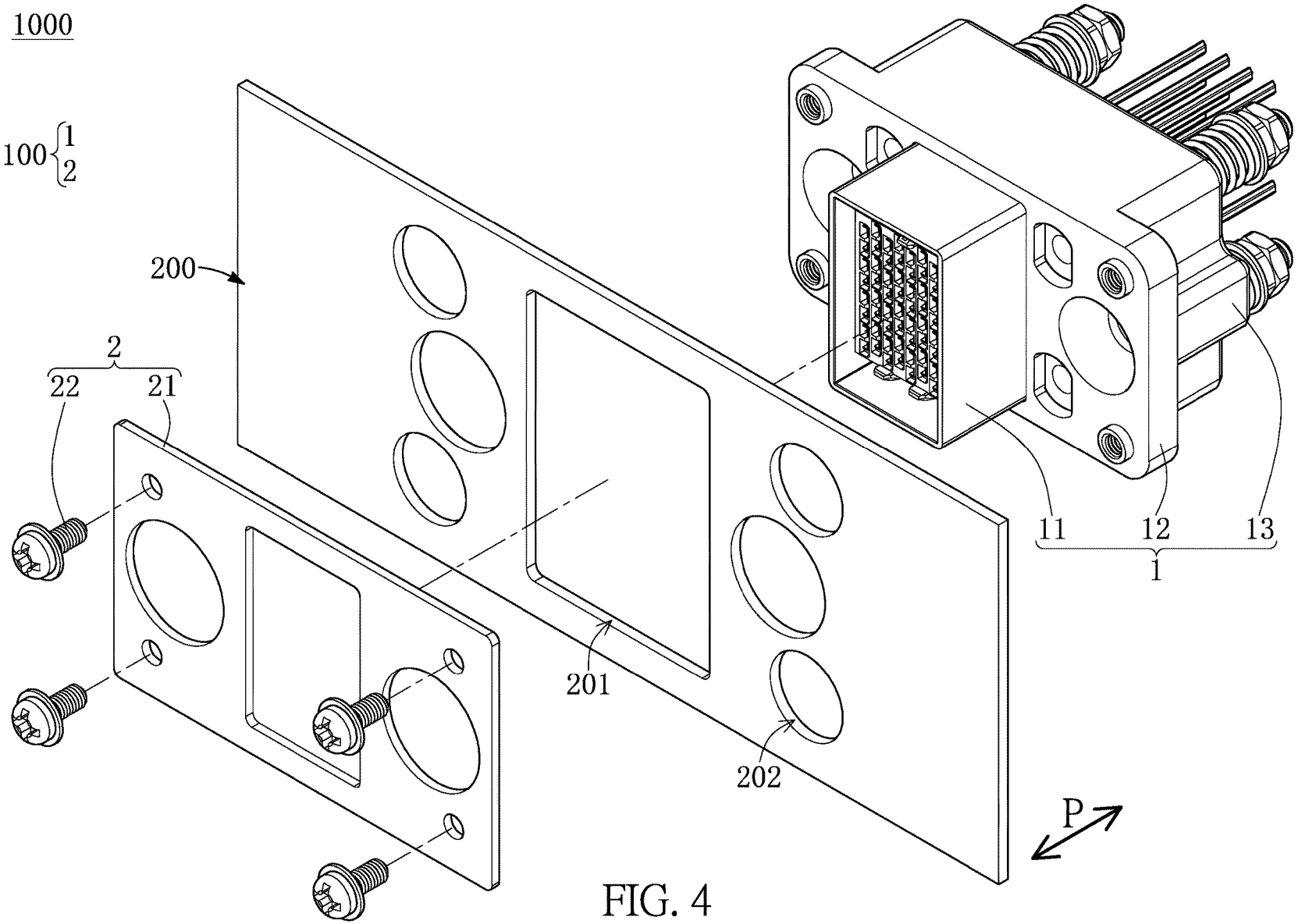
FIG. 4 is an exploded view of FIG. 1.
Figure 5:
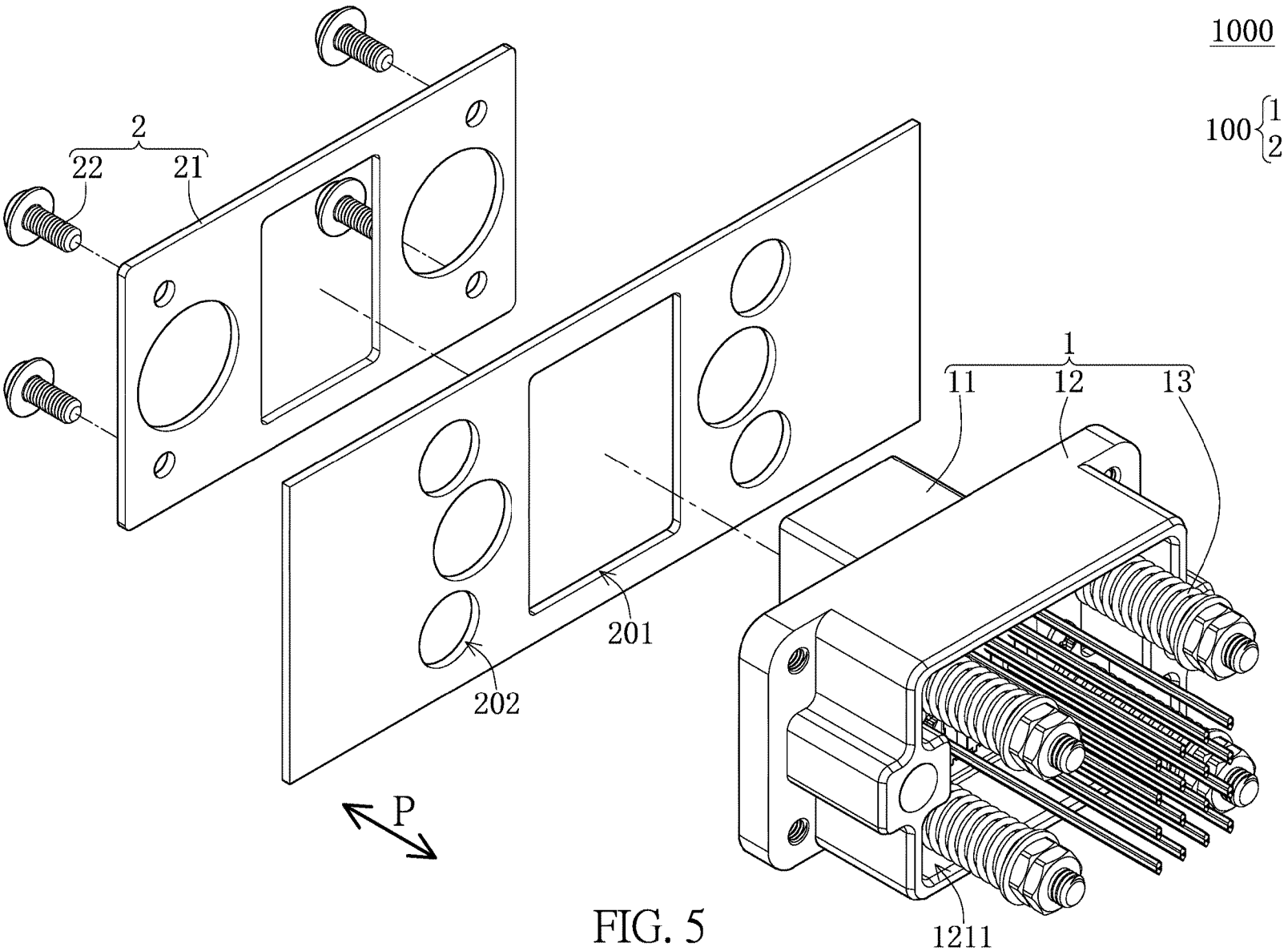
FIG. 5 is an exploded view of FIG. 2.

Referring to FIG. 1 to FIG. 10, an embodiment of the present disclosure provides a connection device 1000 including a panel 200 and a floating connection assembly 100 that is movably assembled to the panel 200 (shown in FIG. 1 to FIG. 3). As shown in FIG. 4 and FIG. 5, the panel 200 has a first thru-hole 201 and a plurality of second thru-holes 202 that are arranged around the first thru-hole 201. The first thru-hole 201 is substantially arranged at a central portion of the panel 200. Moreover, the floating connection assembly 100 in the present embodiment is fastened to the first thru-hole 201 and the second thru-holes 202 of the panel 200, but the present disclosure is not limited thereto. For example, in other embodiments of the present disclosure, the floating connection assembly 100 can be independently used (e.g., sold) or can be used in cooperation with other components. The following description describes the structure and connection relationship of each component of the floating connection assembly 100.

Figure 6:
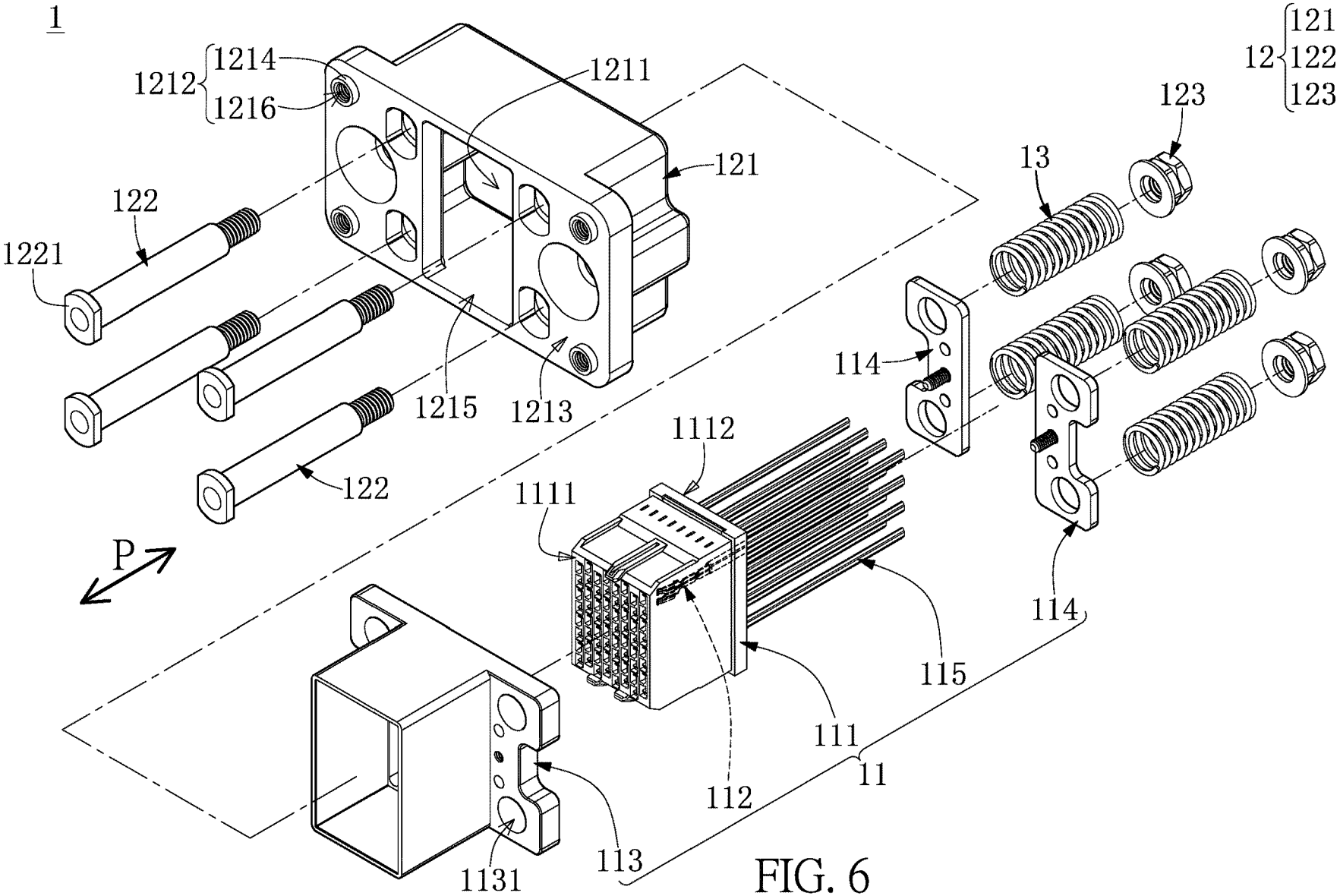
FIG. 6 is an exploded view of a floating connector shown in FIG. 4.
Figure 7:
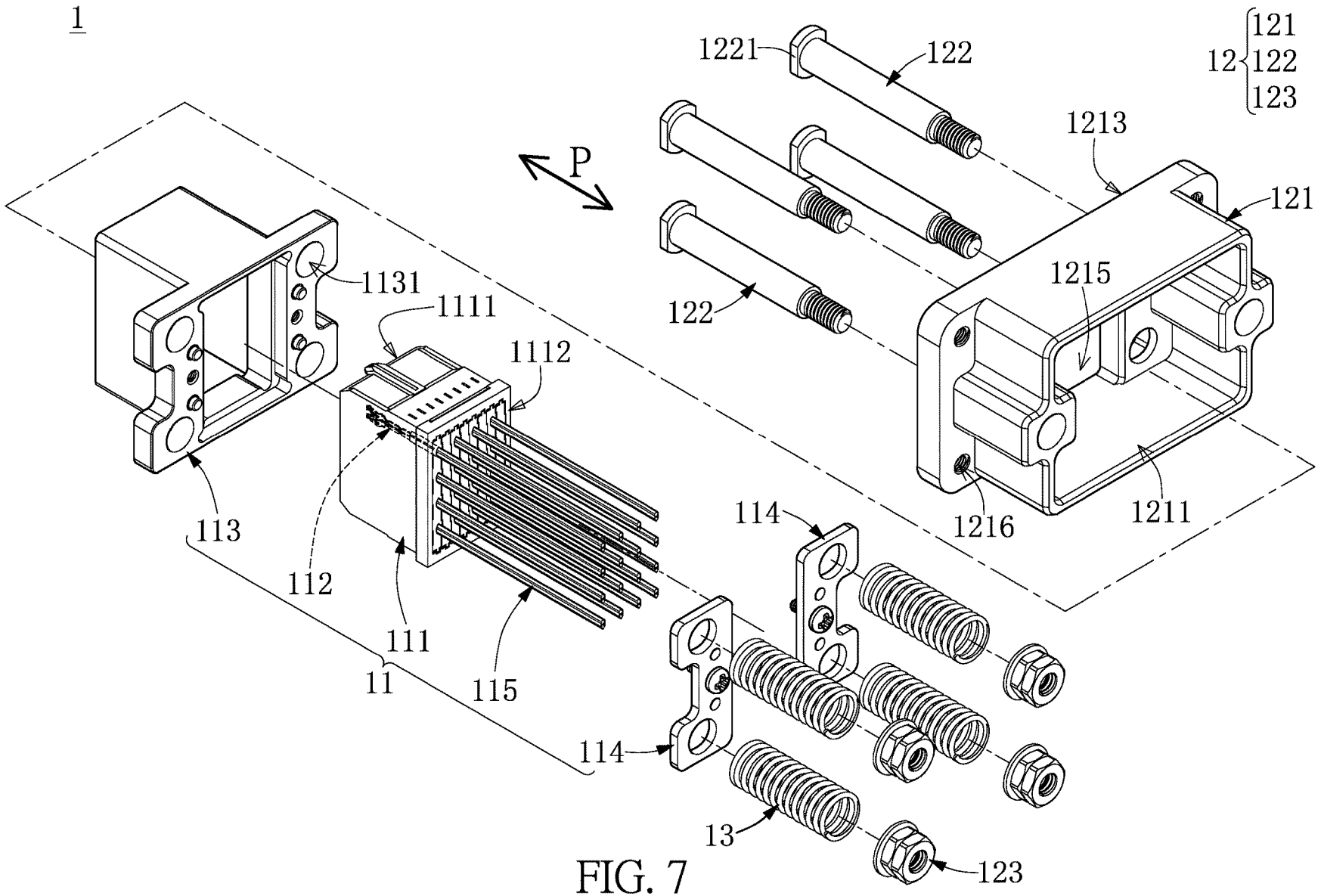
FIG. 7 is an exploded view of the floating connector shown in FIG. 5.

As shown in FIG. 5 to FIG. 7, the floating connection assembly 100 includes a floating connector 1 and an assembling module 2 that is configured to fasten the floating connector 1 to the panel 200. The floating connector 1 includes a main body 11, a floating module 12 assembled to the main body 11, and a plurality of elastic components 13 that are abutted against and arranged between the main body 11 and the floating module 12. Moreover, the main body 11 in the present embodiment is a high density cable connector, and each of the elastic components 13 is a compression spring. The mode of the main body 11 and the mode and quantity of the elastic component 13 can be adjusted or changed according to design requirements, and are not limited to the present embodiment.

Figure 8:
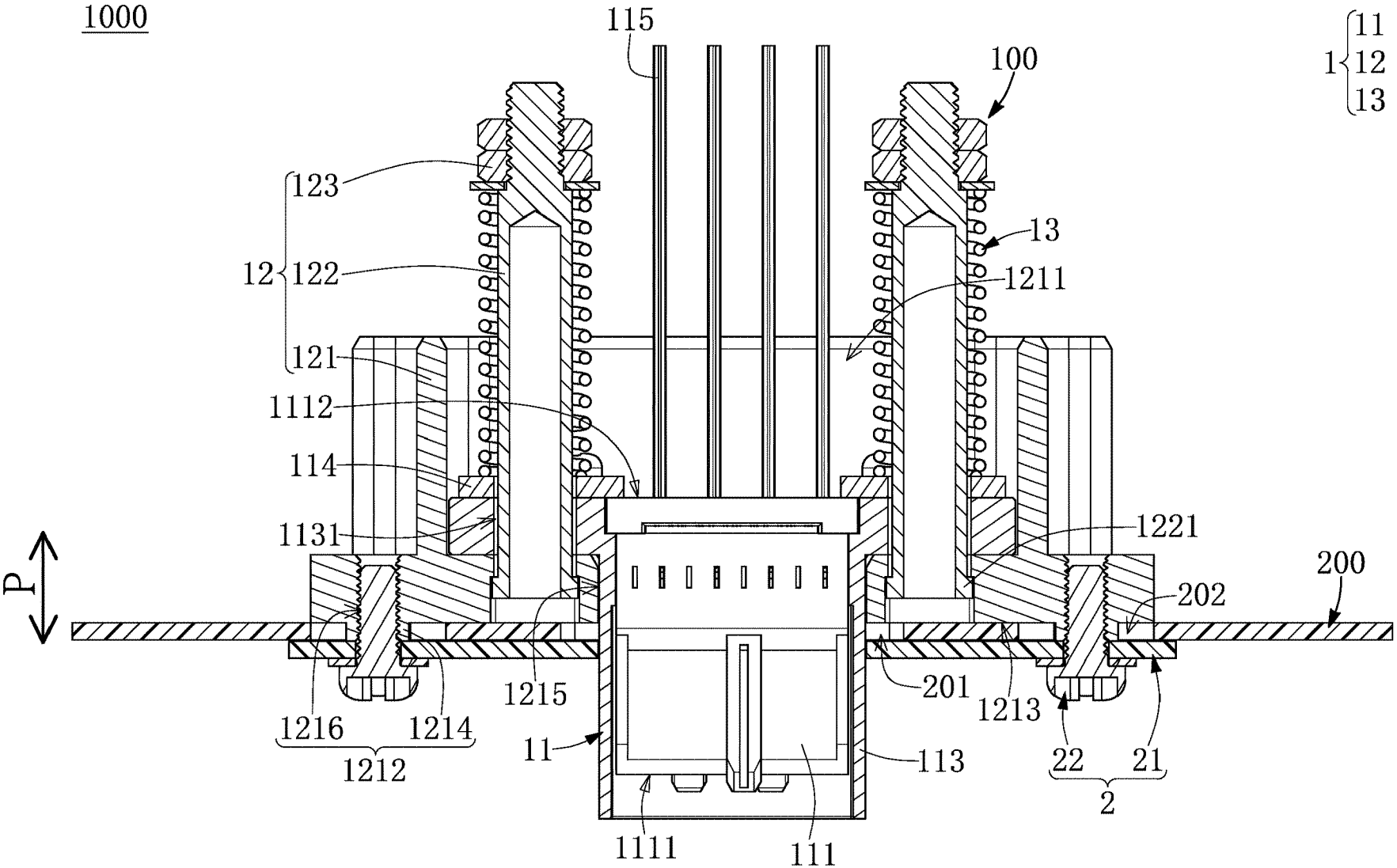
FIG. 8 is a cross-sectional view taken along line VIII-VIII of FIG. 3.

In the present embodiment, as shown in FIG. 6 to FIG. 8, the main body 11 includes an insulating housing 111, a plurality of conductive terminals 112 fastened to the insulating housing 111, a supporting housing 113 sleeved around an outer side of the insulating housing 111, two pressing boards 114 sandwiched between the supporting housing 113 and the floating module 12 (or arranged between the supporting housing 113 and the elastic components 13), and a plurality of cables 115 that are respectively connected to the conductive terminals 112.

The insulating housing 111 has an insertion end 1111 and an assembling end 1112 that is opposite to the insertion end 1111. The conductive terminals 112 are inserted into the insulating housing 111. The supporting housing 113 surrounds the insulating housing 111, and the insertion end 1111 and the assembling end 1112 of the insulating housing 111 are arranged in the supporting housing 113, and the insertion end 1111 of the insulating housing 111 is configured to be connected to a mating connector (not shown in figures) along an insertion direction P. The assembling end 1112 of the insulating housing 111 is substantially coplanar with an adjacent surface of the supporting housing 113.

Moreover, the main body 11 has a plurality of perforation holes 1131 formed in the supporting housing 113. The perforation holes 1131 in the present embodiment are arranged in two rows that are respectively arranged on two opposite sides of the supporting housing 113 adjacent to the assembling end 1112. The two pressing boards 114 are abutted against the assembling end 1112 of the insulating housing 111 and the adjacent surface of the supporting housing 113 so as to fix the insulating housing 111 into the supporting housing 113. The two pressing boards 114 in the present embodiment are respectively disposed on two portions of the supporting housing 113 that respectively have the two rows of the perforation holes 1131, but the present disclosure is not limited thereto. In addition, the cables 115 are respectively connected to portions of the conductive terminals 112 adjacent to the assembling end 1112, and the cables 115 are exposed from the insulating housing 111 (or the assembling end 1112 of the insulating housing 111) and the supporting housing 113 and are substantially located between the two pressing boards 114.

In other embodiments of the present disclosure, ends of the two pressing boards 114 can be connected to jointly form a ring-shaped structure, so that the quantity of the pressing board 114 of the main body 11 can be only one. In other words, the quantity of the pressing board 114 of the main body 11 can be at least one, and the at least one pressing board 114 is abutted against the insulating housing 111 so as to fix the insulating housing 111 into the supporting housing 113.

The floating module 12 defines an assembling region 1211 and a plurality of holding regions 1212 that are distributed around the assembling region 1211. The main body 11 is inserted into the assembling region 1211 of the floating module 12, and the elastic components 13 are arranged or disposed in the assembling region 1211 and are elastically deformable along the insertion direction P. Moreover, two ends of each of the elastic components 13 are respectively abutted against the floating module 12 and the main body 11, so that the main body 11 can be movable along the insertion direction P relative to the floating module 12 through at least one of the elastic components 13.

Figure 9:
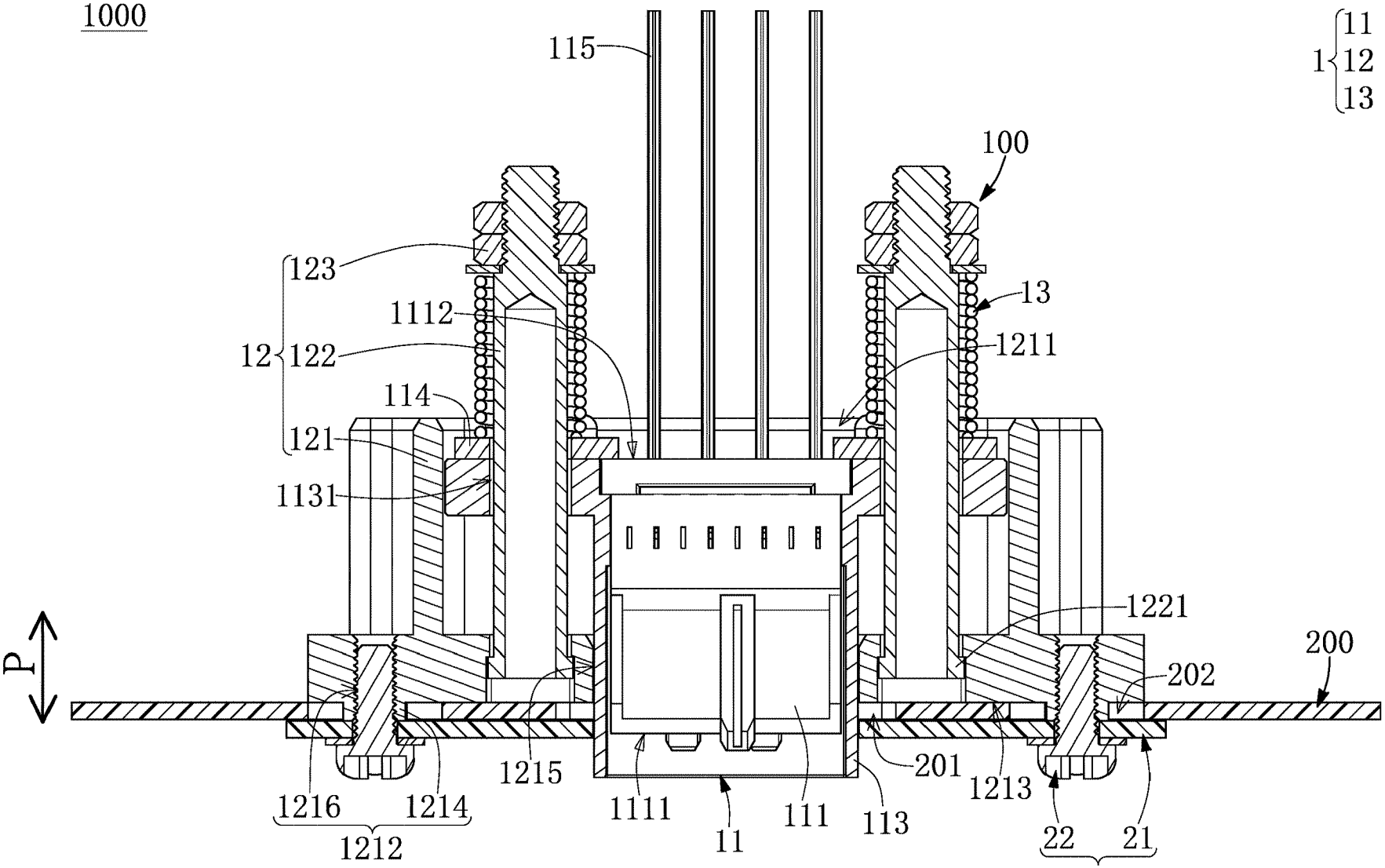
FIG. 9 is a cross-sectional view showing the connection device of FIG. 8 when a main body of the floating connector is moved along an insertion direction.

Accordingly, the floating connector 1 in the present embodiment can be precisely inserted into the mating connector by having the elastic components 13 that are abutted against the floating module 12 and the main body 11 and by having the main body 11 that is movable along the insertion direction P relative to the floating module 12 (as shown in FIG. 9) through at least one of the elastic components 13.

It should be noted that the floating module 12 can be any structure satisfying the above features. In other words, the floating module 12 can be provided in many different structures. In order to describe the present embodiment, the following description describes the floating module 12 provided in one of the different structures, but the present disclosure is not limited thereto.

In the present embodiment, the floating module 12 includes a floating housing 121, a plurality of guiding rods 122 fixed to the floating housing 121, and a plurality of restricting components 123 (e.g., screw nuts) that are respectively assembled to the guiding rods 122. The floating housing 121 is formed with the assembling region 1211 and the holding regions 1212. In the present embodiment, a trough-like space formed by the floating housing 121 is defined as the assembling region 1211, and each corner of the floating housing 121 is formed with (or has) one of the holding regions 1212.

Moreover, the floating module 12 includes an abutting surface 1213 arranged on the floating housing 121 and a plurality of protrusions 1214 that extend from the abutting surface 1213, and the protrusions 1214 are respectively arranged in the holding regions 1212. The abutting surface 1213 is a surface of the floating housing 121 away from the restricting components 123, and a substantial center portion of the abutting surface 1213 of the floating housing 121 has an accommodating hole 1215 in spatial communication with the assembling region 1211. The floating module 12 has a plurality of concavities 1216 respectively recessed in the protrusions 1214. In other words, the concavities 1216 are respectively arranged in the holding regions 1212, and each of the concavities 1216 in the present embodiment is a penetrating screw hole, but the present disclosure is not limited thereto.

A portion of the main body 11 (e.g., the insertion end 1111 of the insulating housing 111 and adjacent parts of other components of the main body 11) protrudes from the accommodating hole 1215 of the floating housing 121, and another portion of the main body 11 (e.g., the assembling end 1112 of the insulating housing 111 and adjacent parts of other components of the main body 11) is arranged in the assembling region 1211 of the floating module 12.

Specifically, a portion of the supporting housing 113 protrudes from the accommodating hole 1215 of the floating housing 121. Another portion of the supporting housing 113 (e.g., the perforation holes 1131), portions of other components arranged therein, and the two pressing boards 114 are arranged in the assembling region 1211 of the floating module 12.

Moreover, the guiding rods 122 sequentially pass through the floating housing 121, the perforation holes 1131 of the supporting housing 113, the two pressing boards 114, the elastic components 13, and the restricting components 123 along the insertion direction P. End portions 1221 of the guiding rods 122 are respectively arranged in (or engaged with) and fixed to portions of the floating housing 121 that are respectively located at two opposite sides of the accommodating hole 1215. The guiding rods 122 respectively pass through the perforation holes 1131 of the supporting housing 113. The end portion 1221 of each of the guiding rods 122 is limited or retained by the floating housing 121, so that the end portion 1221 of each of the guiding rods 122 is not rotated relative to the corresponding perforation hole 1131.

In addition, the guiding rods 122 respectively pass through the elastic components 13 one to one along the insertion direction P, and an end (e.g., the end portions 1221) of the guiding rods 122 are assembled to the floating housing 121 (e.g., the abutting surface 1213). The restricting components 123 are respectively fixed to another end of the guiding rods 122, and are respectively butted against an end of the elastic components 13. The main body 11 is movably assembled to the guiding rods 122 along the insertion direction P, and the main body 11 (e.g., the pressing boards 114) is abutted against another end of the elastic components 13 (e.g., the main body 11 and each of the restricting components 123 are configured to jointly clamp one of the elastic components 13), so that the elastic components 13 are configured to tend to maintain the main body 11 abutting against the floating housing 121.

Figure 10:
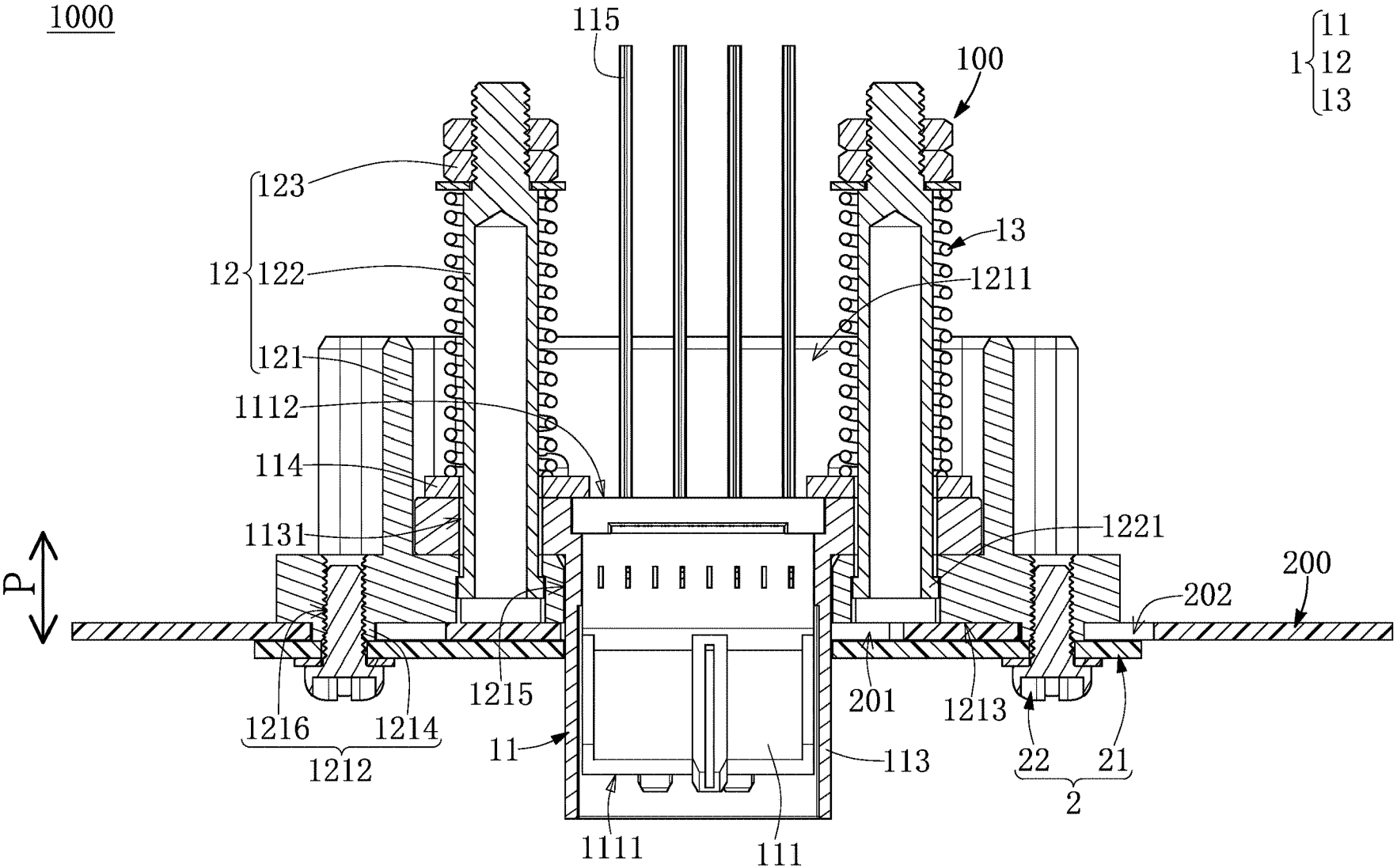
FIG. 10 is a cross-sectional view showing the connection device of FIG. 8 when the floating connection assembly is moved relative to a panel.

The main body 11 passes through the first thru-hole 201 of the panel 200, and the holding regions 1212 respectively correspond in position to the second thru-holes 202 of the panel 200. The assembling module 2 passes through the second thru-holes 202 and is retained by the floating module 12 through the holding regions 1212, so that the floating module 12 and the assembling module 2 can be jointly configured to movably clamp the panel 200 (as shown in FIG. 10). Moreover, the main body 11 is spaced apart from an inner wall of the first thru-hole 201 by a distance (e.g., a first distance), and a portion of the assembling module 2 arranged in any one of the second thru-holes 202 is spaced apart from an inner wall of the corresponding second thru-hole 202 by a distance (e.g., a second distance), so that the floating connector 1 and the assembling module 2 can be jointly movable relative to the panel 200. Specifically, the first distance defined by the main body 11 and the inner wall of the first thru-hole 201 can be equal to or not equal to the second distance that is defined by the portion of the assembling module 2 arranged in any one of the second thru-holes 202 and the inner wall of the corresponding second thru-hole 202, but the present disclosure is not limited thereto.

Accordingly, the floating connector 1 and the assembling module 2 of the floating connection assembly 100 are jointly used in cooperation with the panel 200 so as to provide the floating connection assembly 100 with a floating function for overcoming the existing technical prejudice. Specifically, the main body 11 of the floating connector 1 can be floated (or moved) along different directions to effectively improve (or absorb) a deviation generated from the floating connector 1, so that the floating connector 1 can be precisely inserted into the mating connector.

It should be noted that the assembling module 2 can be any structure satisfying the above features. In other words, the assembling module 2 can be provided in many different structures. In order to describe the present embodiment, the following description describes the assembling module 2 provided in one of the different structures that is only used in cooperation with the above floating module 12 of the present embodiment, but the present disclosure is not limited thereto.

As shown in FIG. 4, FIG. 5, and FIG. 8, the assembling module 2 in the present embodiment includes a baffle 21 and a plurality of retainers 22 (e.g., screw nails) that pass through the baffle 21. Moreover, the panel 200 is sandwiched between the abutting surface 1213 of the floating connector 1 and the baffle 21 of the assembling module 2, a part of the main body 11 (e.g., the supporting housing 113, the insertion end 1111 of the insulating housing 111, and adjacent parts of other components of the main body 11) protrudes from the first thru-hole 201 of the panel 200 and the baffle 21, and the retainers 22 are fixed to the holding regions 1212 by respectively passing through the second thru-holes 202. In other words, the retainers 22 are respectively screwed into the concavities 1216 by passing through the second thru-holes 202. Specifically, the part (e.g., the portion of the supporting housing 113) of the main body 11 protruding from the first thru-hole 201 is spaced apart from an inner wall of the first thru-hole 201 by the first distance, and the portion (e.g., the retainers 22) of the assembling module 2 arranged in any one of the second thru-holes 202 is spaced apart from an inner wall of the corresponding second thru-hole 202 by the second distance, so that the floating module 12 and the baffle 21 are jointly configured to movably clamp the panel 200 by the first distance and the second distance.

Specifically, the baffle 21 partially covers one side of the first thru-hole 201 and one side of the second thru-holes 202 (e.g., the lower side the first thru-hole 201 and the lower side of the second thru-holes 202 shown in FIG. 8 away from the abutting surface 1213) along the insertion direction P, and the abutting surface 1213 covers another side of the first thru-hole 201 and another side of the second thru-holes 202 (e.g., the upper side the first thru-hole 201 and the upper side of the second thru-holes 202 shown in FIG. 8 adjacent to the abutting surface 1213) along the insertion direction P. The end portion 1221 of each of the guiding rods 122 is restricted along the insertion direction P by the panel 200.

Moreover, the protrusions 1214 are abutted against the baffle 21 and are respectively arranged in the second thru-holes 202. Each of the protrusions 1214 is spaced apart from the inner wall of the corresponding second thru-hole 202 by a distance (e.g., a third distance). Specifically, the second distance can be equal to or not equal to the third distance. In other words, the concavities 1216 respectively correspond in position to the second thru-holes 202 along the insertion direction P, and an inner diameter of each of the concavities 1216 is smaller than an inner diameter of the corresponding second thru-hole 202. A thickness of each of the protrusions 1214 is equal to or greater than that of the panel 200, so that the abutting surface 1213 can be maintained to be spaced apart from the baffle 21 by a predetermined interval, and the floating module 12 and the baffle 21 are jointly configured to movably clamp the panel 200.

Specifically, the floating module 12 and the assembling module 2 that is retained by the floating module 12 can be jointly movable relative to the panel 200 (along a parallel direction of the panel 200) by at least one of the first distance, the second distance, the third distance, and the predetermined interval.

In conclusion, the floating connector and the assembling module of the floating connection assembly in the present disclosure are jointly used in cooperation with the panel so as to provide the floating connection assembly with a floating function for overcoming the existing technical prejudice. Specifically, the main body of the floating connector can be floated (or moved) along different directions to effectively improve (or absorb) a deviation generated from the floating connector, so that the floating connector can be precisely inserted into the mating connector.

Moreover, the elastic components in the present disclosure are abutted against the floating module and the main body, so that the main body can be movable along the insertion direction relative to the floating module through at least one of the elastic components. Accordingly, the floating connector or the floating connection assembly in the present disclosure can be precisely inserted into a mating connector.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A connection device, comprising:

a panel having a first thru-hole and a plurality of second thru-holes that are arranged around the first thru-hole; and a floating connection assembly including:

a floating connector including:

a floating module defining an assembling region and a plurality of holding regions that are distributed around the assembling region and that respectively correspond in position to the second thru-holes, wherein the floating module includes an abutting surface and a plurality of protrusions that extend from the abutting surface, and the protrusions are respectively arranged in the holding regions; and a main body inserted into the assembling region of the floating module and passing through the first thru-hole; and an assembling module passing through the second thru-holes and retained by the floating module through the holding regions, wherein the protrusions are abutted against the assembling module and are respectively arranged in the second thru-holes, so that the abutting surface is maintained to be spaced apart from the assembling module by a predetermined interval, and wherein the floating module and the assembling module are jointly configured to movably clamp the panel, wherein the main body is spaced apart from an inner wall of the first thru-hole by a distance, and a portion of the assembling module arranged in any one of the second thru-holes is spaced apart from an inner wall of the corresponding second thru-hole by a distance, so that the floating connector and the assembling module are jointly movable relative to the panel.

2. The connection device according to claim 1, wherein the assembling module includes a baffle and a plurality of retainers that pass through the baffle, and wherein the retainers are fixed to the holding regions by respectively passing through the second thru-holes, so that the floating module and the baffle are jointly configured to movably clamp the panel.

3. The connection device according to claim 1, wherein the floating module has a plurality of concavities respectively arranged in the holding regions, and the concavities respectively correspond in position along an insertion direction to the second thru-holes, and wherein an inner diameter of each of the concavities is smaller than an inner diameter of the corresponding second thru-hole.

4. The connection device according to claim 2, wherein the floating module has a plurality of concavities respectively recessed in the protrusions, and wherein the protrusions are abutted against the baffle, each of the protrusions is spaced apart from the inner wall of the corresponding second thru-hole by a distance, and a thickness of each of the protrusions is greater than or equal to that of the panel, so that the abutting surface is maintained to be spaced apart from the baffle by the predetermined interval.

5. The connection device according to claim 4, wherein the retainers of the assembling module are respectively screwed into the concavities by passing through the second thru-holes, so that the floating module and the baffle are jointly configured to movably clamp the panel.

6. The connection device according to claim 4, wherein the baffle partially covers one side of the first thru-hole and one side of the second thru-holes along an insertion direction, and the abutting surface covers another side of the second thru-holes along the insertion direction.

7. The connection device according to claim 1, wherein the floating connector includes a plurality of elastic components arranged in the assembling region, and the elastic components are elastically deformable along an insertion direction, and wherein two ends of each of the elastic components are respectively abutted against the floating module and the main body, so that the main body is movable along the insertion direction relative to the floating module through at least one of the elastic components.

8. The connection device according to claim 7, wherein the floating module includes:

a floating housing formed with the assembling region and the holding regions;

a plurality of guiding rods respectively passing through the elastic components along the insertion direction, wherein an end of the guiding rods is assembled to the floating housing; and a plurality of restricting components respectively fixed to another end of the guiding rods and respectively abutted against an end of the elastic components, wherein the main body is movably assembled to the guiding rods along the insertion direction and is abutted against another end of the elastic components, and the elastic components are configured to tend to maintain the main body abutting against the floating housing.

9. The connection device according to claim 8, wherein the main body has a plurality of perforation holes, an end portion of each of the guiding rods is arranged in and fixed to the floating housing, the guiding rods respectively pass through the perforation holes, and the end portion of each of the guiding rods is not rotated relative to the corresponding perforation hole, and wherein the end portion of each of the guiding rods is restricted along the insertion direction by the panel.

10. A floating connection assembly, comprising:

a floating connector including:

a floating module defining an assembling region and a plurality of holding regions that are distributed around the assembling region, wherein the floating module includes an abutting surface and a plurality of protrusions that extend from the abutting surface, and the protrusions are respectively arranged in the holding regions; and a main body inserted into the assembling region of the floating module; and an assembling module retained by the floating module through the holding regions, wherein the protrusions are abutted against the assembling module, so that the abutting surface is maintained to be spaced apart from the assembling module by a predetermined interval, and wherein the floating module and the assembling module are jointly configured to movably clamp a panel, and are jointly movable relative to the panel.

11. The floating connection assembly according to claim 10, wherein the main body includes an insulating housing, a plurality of conductive terminals fastened to the insulating housing, a supporting housing sleeved around an outer side of the insulating housing, and at least one pressing board that is sandwiched between the supporting housing and the floating module, and wherein the at least one pressing board is abutted against the insulating housing so as to fix the insulating housing into the supporting housing.

12. The floating connection assembly according to claim 10, wherein the floating module has a plurality of concavities respectively recessed in the protrusions, wherein the assembling module includes a baffle and a plurality of retainers that pass through the baffle, and wherein the retainers are respectively screwed into the concavities, and the protrusions are abutted against the baffle, so that the abutting surface is maintained to be spaced apart from the baffle by the predetermined interval, and the floating module and the baffle are jointly configured to movably clamp the panel.

13. A floating connection assembly, comprising:

a floating connector including:

a floating module defining an assembling region and a plurality of holding regions that are distributed around the assembling region, wherein the floating module includes an abutting surface; and a main body inserted into the assembling region of the floating module; and an assembling module having a baffle and retained by the floating module through the holding regions, wherein the abutting surface of the floating module and the baffle of the assembling module are jointly configured to movably clamp a panel, and are jointly movable relative to the panel that has a first thru-hole and a plurality of second thru-holes arranged around the first thru-hole, wherein the baffle is configured to partially cover one side of the first thru-hole and one side of the second thru-holes along an insertion direction, and the abutting surface is configured to cover another side of the second thru-holes along the insertion direction.

14. The floating connection assembly according to claim 13, wherein the main body includes an insulating housing, a plurality of conductive terminals fastened to the insulating housing, a supporting housing sleeved around an outer side of the insulating housing, and at least one pressing board that is sandwiched between the supporting housing and the floating module, and wherein the at least one pressing board is abutted against the insulating housing so as to fix the insulating housing into the supporting housing.

15. The floating connection assembly according to claim 13, wherein the floating module includes a plurality of protrusions that extend from the abutting surface, and the protrusions are respectively arranged in the holding regions, wherein the floating module has a plurality of concavities respectively recessed in the protrusions, wherein the assembling module includes a plurality of retainers that pass through the baffle, and wherein the retainers are respectively screwed into the concavities, and the protrusions are abutted against the baffle, so that the abutting surface is maintained to be spaced apart from the baffle by a predetermined interval.

* * * * *